US008919175B2

(12) United States Patent
Kinoshita

(10) Patent No.: US 8,919,175 B2
(45) Date of Patent: Dec. 30, 2014

(54) PRESS WORKING DIE ASSEMBLY

(75) Inventor: Shinji Kinoshita, Tokyo (JP)

(73) Assignee: Yourbusiness Co., Ltd., Tokyo (JP)

( * ) Notice: Subject to any disclaimer, the term of this patent is extended or adjusted under 35 U.S.C. 154(b) by 795 days.

(21) Appl. No.: 13/170,302

(22) Filed: Jun. 28, 2011

(65) Prior Publication Data

US 2012/0067105 A1 Mar. 22, 2012

(30) Foreign Application Priority Data

Sep. 17, 2010 (JP) ..... 2010-209092

(51) Int. Cl.

| | |
|---|---|
| ***B21J 13/00*** | (2006.01) |
| ***B21D 19/08*** | (2006.01) |
| ***B21D 22/06*** | (2006.01) |
| *B21D 11/00* | (2006.01) |

(52) U.S. Cl.

CPC ..... *B21D 19/08* (2013.01); *B21D 19/082* (2013.01); *B21D 22/06* (2013.01)

USPC ..... 72/452.9; 72/452.8; 72/452.6; 72/452.4; 72/315

(58) Field of Classification Search

CPC ..... B21D 39/021; B21D 5/04; B21D 19/08; B21D 24/12; B21D 19/086; B21D 5/042; B21D 41/02; B21D 1/10; B21D 5/045; B21D 7/022; B21D 22/02; B21D 28/20; B21D 1/00; B21D 28/002; B21D 35/00; B21D 39/06; B21D 24/02; B21D 28/32; B21D 22/30; B21D 22/28; B21D 51/26; B21D 22/26; B21D 51/38; B21C 37/104; B30B 1/14; B30B 1/26; B30B 1/266; B30B 1/40; H01R 43/0428; A43D 5/12; B21F 1/00; B21J 9/18; B21J 15/046; B25B 27/146

USPC ..... 72/312–315, 320–323, 452.1, 452.2, 72/452.4, 452.6, 452.8, 452.9, 347, 348

See application file for complete search history.

(56) References Cited

U.S. PATENT DOCUMENTS

| | | | | |
|---|---|---|---|---|
| 7,243,524 | B2 * | 7/2007 | Kinoshita | 72/381 |
| 7,258,030 | B2 * | 8/2007 | McCallum | 74/122 |
| 7,665,341 | B2 * | 2/2010 | Kinoshita | 72/381 |
| 2002/0121123 | A1 * | 9/2002 | Matsuoka | 72/312 |

(Continued)

FOREIGN PATENT DOCUMENTS

| | | |
|---|---|---|
| JP | 2002-263752 | 9/2002 |
| JP | 2002-263753 | 9/2002 |

*Primary Examiner* — Shelley Self
*Assistant Examiner* — Lawrence Averick
(74) *Attorney, Agent, or Firm* — Wenderoth, Lind & Ponack, L.L.P.

(57) ABSTRACT

A press working die assembly includes a pad secured to an upper die holder so as to be movable upward and downward, a machining slide cam slidable laterally along a cam surface and having a bending edge at one end thereof, a rotatable rotary cam having a bending portion for forming a negative angle portion of a workpiece, and a reciprocating driving apparatus configured to rotate the rotary cam to a workpiece machining position. The reciprocating driving apparatus includes a slide block having a cam surface for rotating the rotary cam in a predetermined direction on an front end side and a rotation impelling surface configured to rotate the rotary cam back to its original position, and a restoring action block configured to come into abutment with the rotation impelling surface of the slide block when the slide block retracts to restore the rotary cam to its original position.

9 Claims, 11 Drawing Sheets

(56) References Cited

U.S. PATENT DOCUMENTS

2003/0226388 A1* 12/2003 Matsuoka ..... 72/314
2004/0007043 A1* 1/2004 Matsuoka ..... 72/452.9
2006/0042348 A1* 3/2006 Krozek ..... 72/452.9
2007/0240483 A1* 10/2007 Kinoshita ..... 72/452.9
2008/0098792 A1* 5/2008 Nieschulz ..... 72/452.4
2009/0205391 A1* 8/2009 Krozek ..... 72/313

* cited by examiner

PRESS WORKING DIE ASSEMBLY

BACKGROUND OF THE INVENTION

1. Field of the Invention

The present invention relates to a die for bending a panel edge portion such as for motor vehicles and, specifically, to a press working die assembly configured to be used for negative angle formation and to form a complex shape with a rotating body.

2. Prior Art

In the prior art, in the structure of a die assembly for forming portions having negative angles in a forming method using a press die assembly, for example, as shown in FIGS. 10A and 10B, a rotating body 4*c* is set to a lower die holder 10 body with an air cylinder 6 or the like. A pad 2 having a pressure source, which serves as a holder of a workpiece set in an upper die holder holds the rotating body 4*c* and a fixed punch 5. Then, a machining cam 3 moves forward and an edge portion of the workpiece is machined. In addition to a configuration in which the substantially L-shaped rotating body 4*c* rotationally moves about a point "a" as shown in FIGS. 10A and 10B as described above, there is a known structure in which a column-shaped rotary cam 4*d* rotates as shown in FIG. 11 (see JP-A-2002-263752, JP-A-2002-263753).

However, in press working die assemblies 1*a* and 1*b* in the prior art, since a pressure with which the pad 2 presses down is as large as several tens of ton, the structural strength against a force in the direction of rotation thereof is weak. Therefore, the rotation of the rotating body 4*c* is prevented by causing the machining cam 3 to hold before the contact of the pad 2. Even with this structure, the machining cam 3 cannot compete with the force of the pad 2. Therefore, it is structurally difficult for the press working die assemblies 1*a* and 1*b* to manufacture high quality products.

Therefore, as shown in FIG. 12A, a slide plate 4*e* is provided in front of the rotating body 4*c*, and a slide block 14 and the air cylinders 6 for activating the slide block 14 are provided below the slide plate 4*e*. There is an improved structure in which the rotating body 4*c* is rotated while pressing an angle R portion of the slide plate 4*e* against a tapered portion at a distal end of the slide block 14 to set the rotating body 4*c*, and then the slide block 14 is caused to make a stroke toward the front.

In this structure, the force of the pad 2 can be received by the rotating body 4*c*. In addition, the thrust generated during the manufacture is also received, so that the quality of the product is improved. However, in this structure, setting of the rotating body 4*c* is achieved by the air cylinder 6, but the rotating body 4*c* cannot be restored to its original position. Therefore, as shown in FIG. 12B, a method of lifting the rotating body 4*c* by a slide pin 15 formed by assembling a spring and a roller bearing is employed for restoring the rotated rotating body 4*c* to its original position. However, this method has problems to be solved as described below.

1) Since the rotating body has to be held with pressurization of the spring, setting of the strength of the spring is difficult, and if the spring is too strong, the slide block can hardly be placed.

2) The cost is inevitably increased, and an installation space is also needed.

3) Determination of whether the rotating body is rotated with absolute certainty or not can hardly be assessed in the stage of designing.

4) When a drive unit (e.g., air cylinder) for restoring the rotating body to its original position is provided separately, the number of components is increased.

SUMMARY OF THE INVENTION

The press working die assembly according to the invention is proposed in order to solve the problems described above.

In order to solve the problem described above and achieve the object, there is provided a press working die assembly for forming a negative angle including: a pad secured to an upper die holder being freely movable upward and downward and configured to hold a workpiece; a machining slide cam having cam surfaces on upper and lower sides and a bending edge on one end side, the machining slide cam being supported on the upper die holder or a lower die holder and being slidable laterally along the cam surfaces; a rotary cam having a bending portion configured to form a negative angle portion on the workpiece and a cam surface for the slide cam and being rotatably supported entirely on the lower die holder so as to be rotated by an external force; and a reciprocating driving apparatus configured to rotate the rotary cam to a workpiece machining position, wherein the reciprocating driving apparatus includes: a slide block having a cam surface configured to rotate the rotary cam in a predetermined direction on a front end side and a rotation impelling surface configured to rotate the rotary cam so as to be restored to its original position at a rear end side; and a restoring action block configured to come into abutment with the rotation impelling surface of the slide block when the slide block retracts to restore the rotary cam to its original position before machining.

Preferably, the slide block of the reciprocating driving apparatus includes a rotary cam supporting surface formed to receive a workpiece pressing force of the pad generated at the time of negative angle formation with a plane orthogonal thereto, and preferably, the reciprocating driving apparatus includes a piston rod which drives the slide block to reciprocate and a joint member between the piston rod and the slide block so as to couple the piston rod and the slide block with a clearance as needed therebetween.

Preferably, the restoring action block is tightened and fixed to a lower surface of the rotary cam with a screw provided so as to be hung in the vertical direction, is bifurcated into an inverted angular U shape straddling the piston rod of the reciprocating driving apparatus, and includes shock absorbing devices provided at portions of bifurcated leg column portions which come into abutment with the rotation impelling surface of the retracting slide block, the shock absorbing devices being configured to alleviate the shock generated at the time of collision, and preferably, the shock absorbing devices are pins having an urging force and projecting from abutting surfaces on the side of the restoring action block.

Preferably, the slide block is provided with a shock absorbing member so as to project from a distal end surface of the slide block, the shock absorbing member alleviating a shock generated when the slide block comes into abutment with a wall surface at a predetermined stop position.

Advantages of the Invention

According to the press working die assembly in the present invention, with the provision of the reciprocating driving apparatus configured to rotate and set the rotary cam at a predetermined position at the time of the negative angle formation, the rotary cam can be restored to its original position before formation, the rotary cam is received by the reciprocating driving apparatus so as to be prevented from rotating by a pressing force applied by the pad, and the number of components required for restoring the rotary cam may be reduced, thereby achieving cost reduction.

In the slide block in the reciprocating driving apparatus, the rotation of the rotary cam can be completely prevented by the rotary cam supporting surface disposed so as to receive the workpiece pressing force of the pad in the orthogonal direction at the time of the negative angle formation. Then, by coupling the reciprocating driving apparatus, for example, an air cylinder with the slide block via the joint member, a force can be applied in parallel to the center of the air cylinder, so that various types of air cylinders can be used.

In addition, since the restoring action block is provided with the shock absorbing device that alleviates a shock generated at the time of collision at a portion abutting against the rotation impelling surface of the retracting slide block, the reciprocating driving apparatus such as the air cylinder can be protected. Then, the shock absorbing device can protect so that the force is applied to the center of a pressing and pulling action device, such as the air cylinder, as the drive unit in the reciprocating driving apparatus. In addition, with the provision of the shock absorbing member also at the distal end side of the slide block, the impact sound may be prevented and the slide block and the metal die can be protected. In this manner, the invention provides various advantageous effects.

DESCRIPTION OF THE PREFERRED EMBODIMENTS

Figure 1:
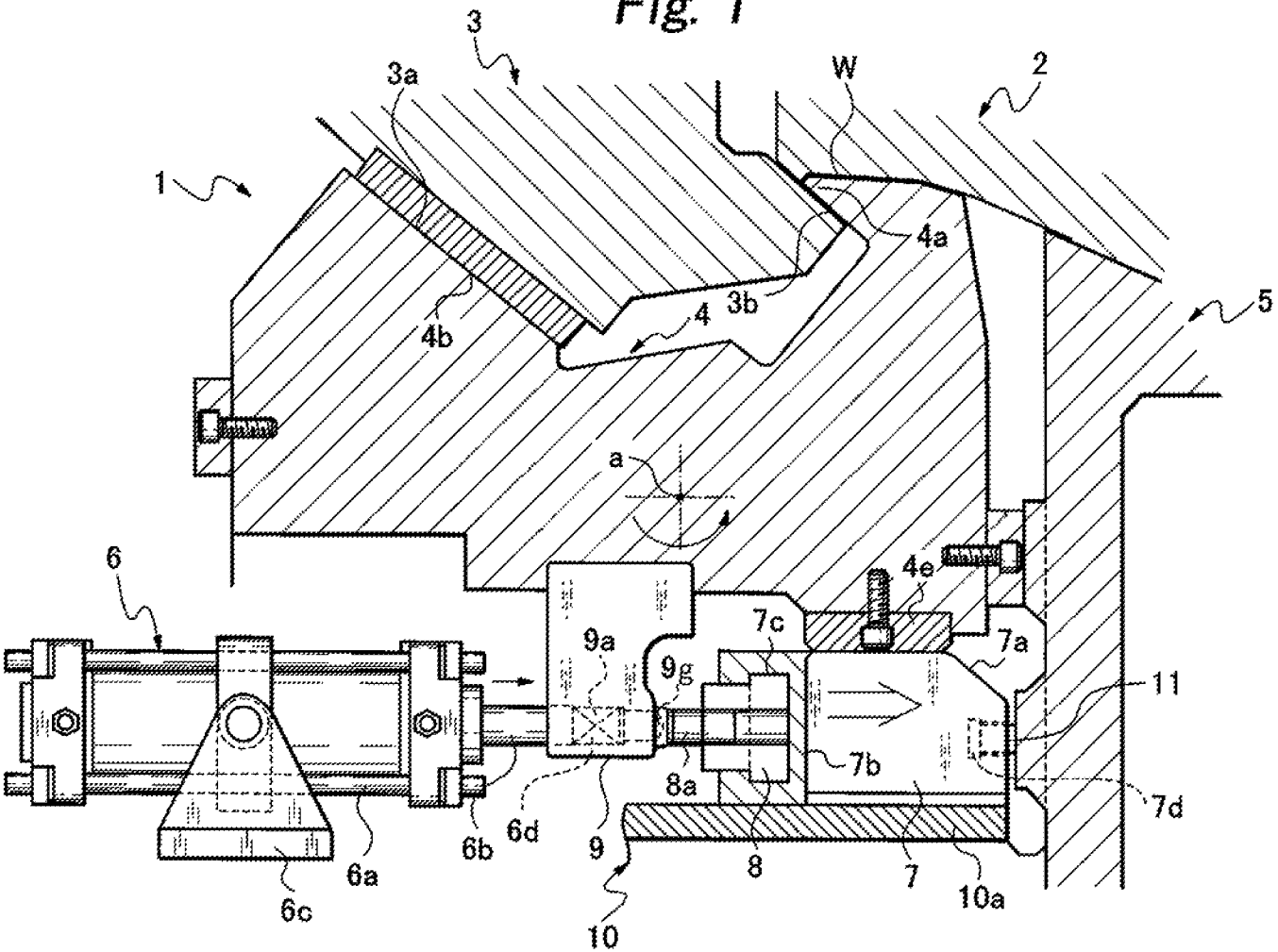
FIG. 1 is a partly enlarged vertical cross-sectional view showing a scene of negative angle formation using a press working die assembly according to the invention.
Figure 2:
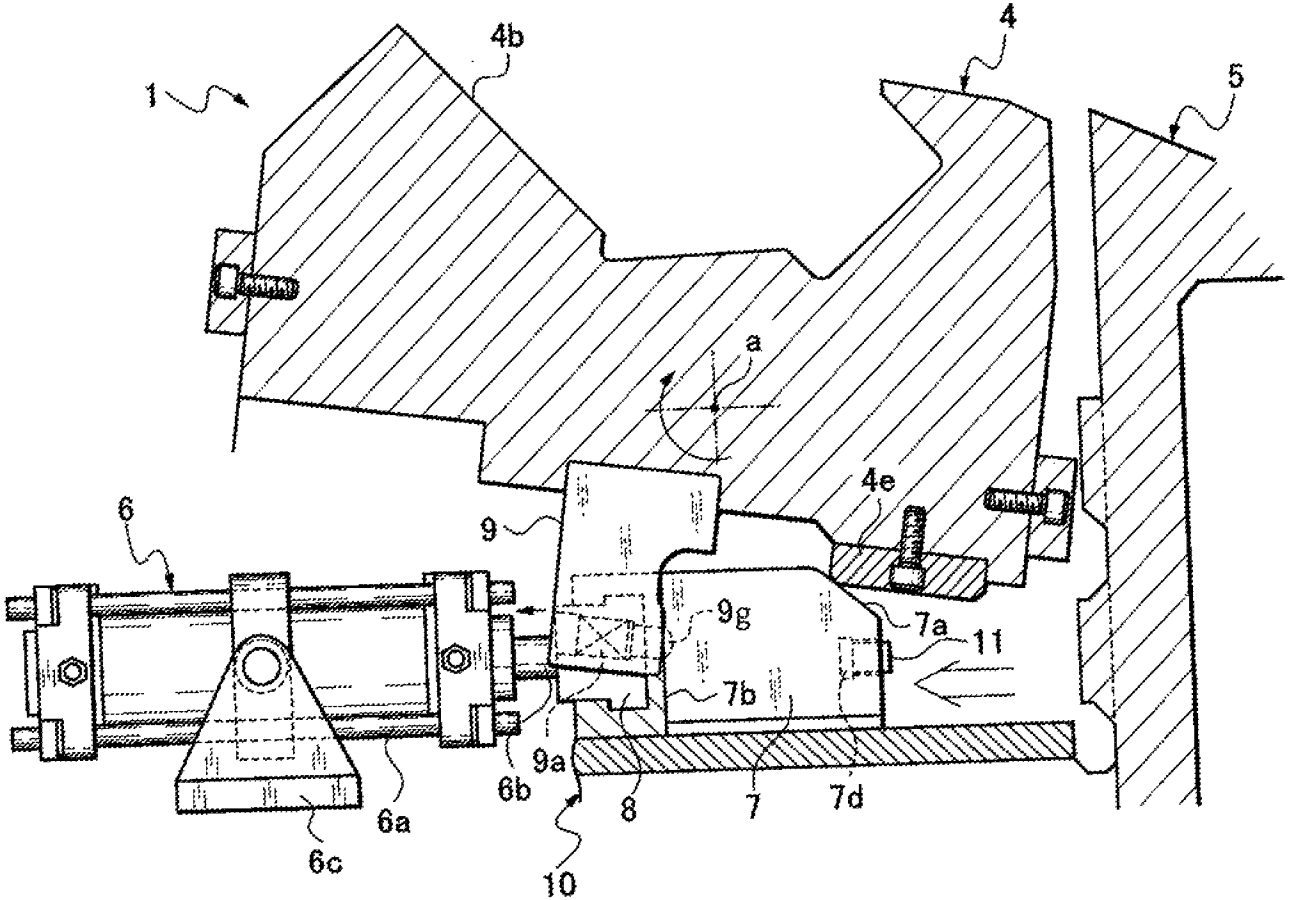
FIG. 2 is a partly enlarged vertical cross-sectional view showing a scene before formation using the same press working die assembly.

FIGS. 1 and 2 show a press working die assembly 1 according to an embodiment of the invention, which includes a pad 2 secured to an upper die holder (not shown) configured to be freely movable upward and downward for holding a workpiece W, a machining slide cam 3 supported on the upper die holder or a lower die holder so as to be slidable laterally along a cam surface 3*a* and including a bending edge 3*b* at an end thereof, a rotary cam 4 having a bending portion 4*a* for forming a negative angle portion of the workpiece W and a cam surface 4*b* for the slide cam 3, being rotatably supported on a lower die holder 10 entirely and rotated by an external force, and a reciprocating driving apparatus 6 configured to rotate the rotary cam 4 to a workpiece machining position.

The reciprocating driving apparatus 6 includes an air cylinder (driving unit) 6*a*, a piston rod (driven member) 6*b*, a supporting table 6*c*, a slide block 7, and a joint block 8. The air cylinder 6*a* is a trunnion type that is a mounting configuration in which pivot pins projecting from both sides of the cylinder are pivotably supported by the supporting table 6*c*. In addition, another mounting configuration such as a foot mounting configuration, or a clevis mounting configuration can also be employed.

In the reciprocating driving apparatus 6, the piston rod 6*b* is coupled to the slide block 7 via the joint block 8, which is a joint member so that no thrust is applied to the piston rod 6*b*. The piston rod 6*b* includes a joint portion 6*d* formed with a thread at a distal end portion thereof, and the joint portion 6*d* is screwed into a screw hole 8*b* on the joint block 8 (see FIGS. 4A to 4C and 6) that engages the slide block 7.

Figure 3A:
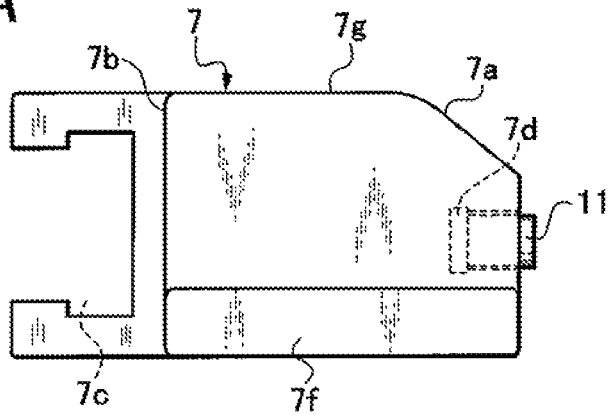
FIG. 3A is a front view of a slide block in the same press working die assembly.
Figure 3B:
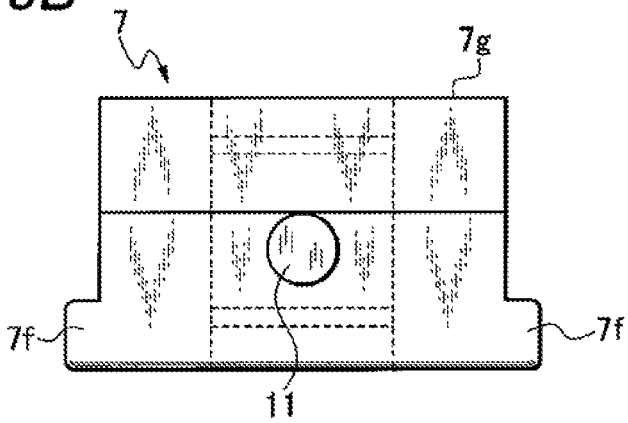
FIG. 3B is a right side view of the slide block in the same press working die assembly.
Figure 3C:
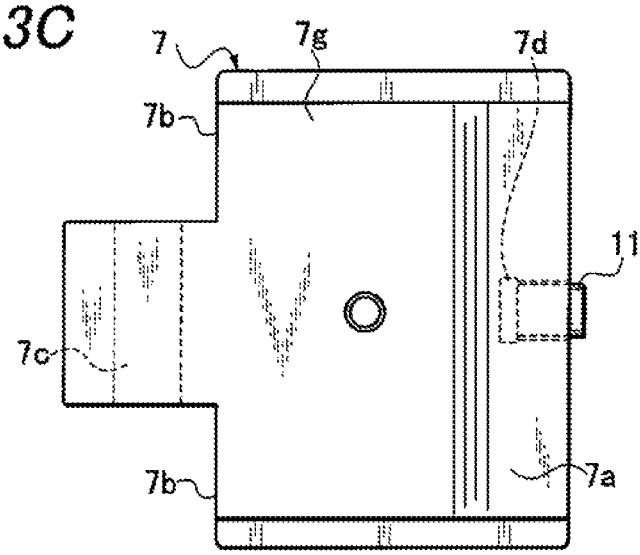
FIG. 3C is a plan view of the slide block in the same press working die assembly.

The slide block 7 includes a cam surface 7*a* formed with an inclined surface at an upper portion of the distal end thereof for rotating the rotary cam 4 in a predetermined direction (direction of curved arrow about the axis a in FIG. 1) as shown in FIGS. 3A to 3C. The slide block 7 also includes guide portions 7*f*, 7*f* to be fitted into guide grooves provided on the lower die holder or the like and guided in the fore-and-aft direction at lower portions on both sides thereof. In addition, the slide block 7 also includes an engaging portion 7*c* on a back surface side so as to project rearward from the center thereof, and rotation impelling surfaces 7*b*, 7*b* on remaining parts of the back surface on both sides for pressing against a restoring action block 9 (to be described below) to cause rotation of the rotary cam 4 and thereby restore the rotary cam 4 to its original position when the slide block 7 is retracted.

The engaging portion 7*c* is formed into a channel, that is C-shaped in cross section, which allows engagement of a flange portion at the distal end of the rectangular joint block 8, described later, and is open on both side surfaces and back surfaces thereof. Also, the slide block 7 includes a depression 7*d* formed at the center of a front end surface thereof. A urethane resin shock absorbing strip 11 is press-fitted into the depression 7*d* in a state in which a distal end of the shock absorbing strip 11 is projected forward from the depression 7*d*. In addition, a horizontal portion of an upper surface of the slide block 7 corresponds to a rotary cam supporting surface 7*g* formed so as to receive a workpiece pressing force of the pad 2 generated at the time of the negative angle formation in the orthogonal direction.

Figure 4A:
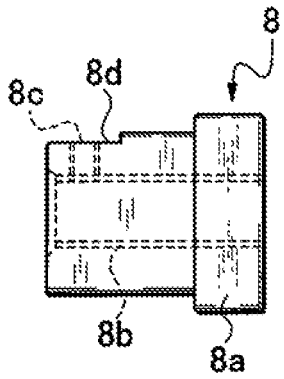
FIG. 4A is a front view of a joint block in the same press working die assembly.
Figure 4B:
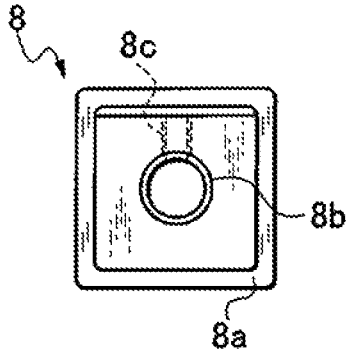
FIG. 4B is a left side view of the joint block in the same press working die assembly.
Figure 4C:
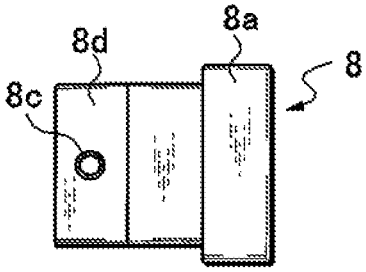
FIG. 4C is a plan view of the joint block in the same press working die assembly.

The joint block 8 includes a rectangular-shaped flange portion 8*a*, and a body portion thinner than the flange portion 8*a* via a shoulder, and the screw hole 8*b* is formed so as to penetrate through the body portion and the flange portion entirely at the center in the fore-and-aft direction as shown in FIGS. 4A to 4C. The joint block 8 is formed with a mounting surface 8*d*, which is slightly lowered in level via a shoulder and a set screw hole 8*c* penetrating to the screw hole 8*b* on a rear end side of an upper surface of the body portion.

Figure 5A:
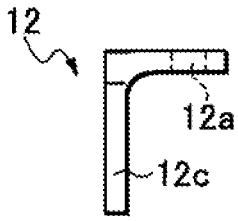
FIG. 5A is a front view of a whirl stop block in the same press working die assembly.
Figure 5B:
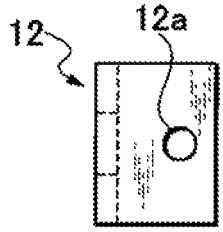
FIG. 5B is a plan view of the whirl stop block in the same press working die assembly.
Figure 5C:
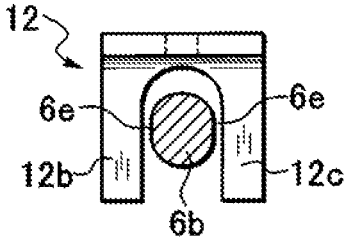
FIG. 5C is a right side view of the whirl stop block in the same press working die assembly.

FIGS. 5A to 5C show a whirl stop block 12 for preventing the rotation of the piston rod 6*b* with respect to the joint block 8. The whirl stop block 12 is a steel block that is L-shaped as a whole, and is formed with a mounting hole 12*a* for allowing insertion of a mounting screw 13 on one side and is formed into an inverted angular U-shape having columns 12*b* and 12*c* on the other side.

Figure 6:
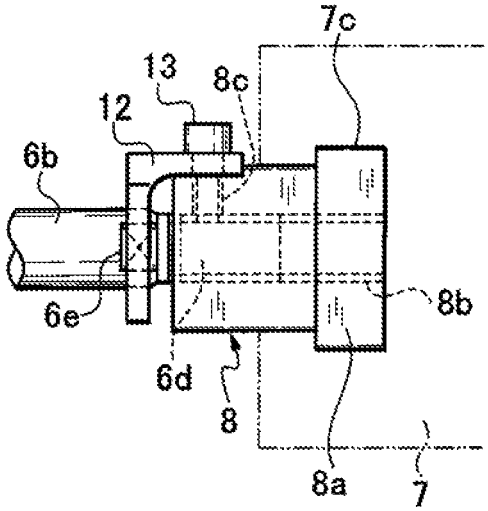
FIG. 6 is a partly enlarged front view of a coupling structure between the joint block and a piston rod of the air cylinder in the same press working die assembly.

The whirl stop block 12 formed as described above is fixed to the joint block 8 by screwing the mounting screw 13 inserted through the mounting hole 12*a* into the set screw hole 8*c* of the mounting surface 8*d* of the joint block 8 as shown in FIG. 6, whereby the whirl stop block 12 is arranged so as to straddle the piston rod 6*b* in a state in which the piston rod 6*b*, whose joint portion 6*d* at the distal end thereof is screwed into the screw hole 8*b*, is inserted between the columns 12*b* and 12*c*. A portion of the piston rod 6*b* where the columns 12*b* and 12*c* straddle is formed with flat portions 6*e*, 6*e* formed by cutting away so as to be parallel to inner side surfaces of the columns 12*b* and 12*c*. The flat portions 6*e*, 6*e* and the inner side surfaces of the columns 12*b* and 12*c* are arranged close to each other through a slight clearance therebetween so as to serve as a whirl stop of the piston rod 6*b* with respect to the joint block 8.

Figure 7A:
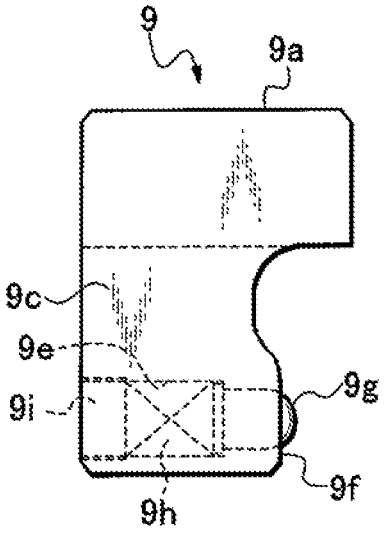
FIG. 7A is a front view of a restoring action block in the same press working die assembly.
Figure 7B:
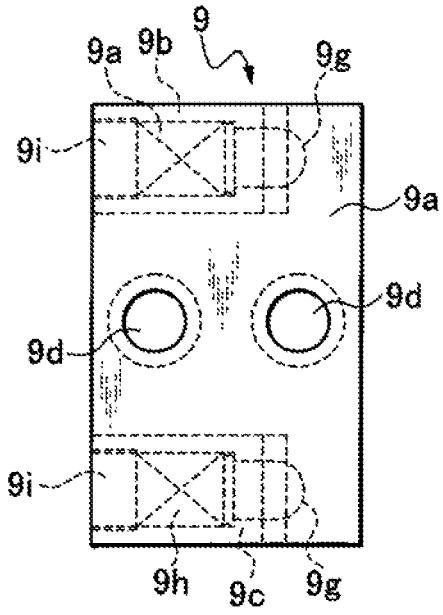
FIG. 7B is a plan view of the restoring action block in the same press working die assembly.
Figure 7C:
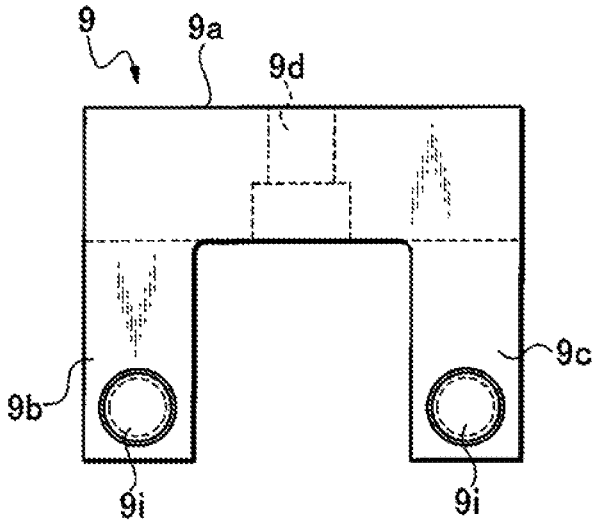
FIG. 7C is a left side view of the restoring action block in the same press working die assembly.

FIGS. 7A to FIG. 7C show a restoring action block 9 that, as shown in FIGS. 1 and 2, projects substantially from the center of the lower portion of the rotary cam 4. The restoring action block 9 includes a mounting portion 9*a* and bifurcated leg column portions 9*b* and 9*c* extending from both end portions of the mounting portion 9*a*, and the mounting portion 9*a* is formed with two mounting holes 9*d*, 9*d* for securing the restoring action block 9 to the rotary cam 4 with screws. The leg column portions 9*b* and 9*c* are arranged so as to straddle the piston rod 6*b*, and pin accommodating holes 9*e* extending respectively in parallel to the piston rod 6*b* are formed at lower end portions thereof. Each of the pin accommodating holes 9*e* is formed to have a hole conforming to the diameter of a flanged pin 9*g* on distal end sides thereof, is formed to have a larger diameter conforming to the diameter of the flange via a shoulder on the back side thereof, and is formed with a thread for allowing a screw plug 9*i* to be fitted and screwed on an end portion on the back surface side thereof. Then, the flanged pins 9*g* having a spherical distal end are inserted into the pin accommodating holes 9*e* with the distal ends thereof projecting therefrom, and coil springs 9*h* are stored therein, and screw plugs 9*i* are screwed so as to push the coil springs 9*h* inward, whereby an urging force is applied to the coil springs 9*h*.

The restoring action block 9 configured as described above is tightened and fixed to a lower surface of the rotary cam 4 with screws inserted into mounting holes 9*d*. Then, as shown in FIGS. 1 and 2, the flanged pins 9*g* urged by the coil springs 9*h* are provided at portions abutting against the rotation impelling surface 7*b* of the retracting slide block 7 as shock absorbing devices projecting from an abutting surface 9*f* on the side of the restoring action block, thereby achieving shock alleviation at the time of collision.

Usage of the press working die assembly 1 according to the invention configured as described above starts from a state before setting the rotary cam 4 shown in FIG. 2. The workpiece W is set to the die, and the air cylinder 6*a* of the reciprocating driving apparatus 6 is driven. Accordingly, when the piston rod 6*b* of the air cylinder 6*a* moves forward, the joint block 8 at the distal end portion of the piston rod 6*b* moves forward and presses the slide block 7 via the engaging portion 7*c* which engages therewith with a clearance as needed, and causes the slide block 7 to slide forward on a slide plate 10*a*.

The slide block 7 is moved forward by the guided portions 7*f* being guided by guiding devices such as guide grooves formed on the lower die holder 10. By the forward movement, the cam surface 7*a* comes into abutment with and pushes up a slide plate 4*e* of the rotary cam 4, and the rotary cam 4 rotates counterclockwise about a point (axis) "a".

When the rotary cam 4 rotates counterclockwise and reaches the state shown in FIG. 1, a distal end portion of the slide block 7 comes into abutment with a vertical wall surface of a fixed punch 5, and the shock generated at the time of abutment is alleviated by the urethane resin shock absorbing strip 11. In this state, an edge portion of the workpiece W is bent by the bending portion 4*a* on the upper portion of the rotary cam 4, the bending edge 3*b* of the machining slide cam 3, and the pad 2. At this time, the significant workpiece pressing force of the pad 2 is received by the slide block 7 immediately below the rotary cam 4.

In order to release the bent workpiece W from the die, the pad 2 is moved upward together with the upper die holder and the machining slide cam 3 is moved rearward along the cam surface 3*a*. Subsequently, the piston rod 6*b* is moved rearward by the activation of the air cylinder 6*a* of the reciprocating driving apparatus 6, and the state shown in FIG. 1 is restored to the state shown in FIG. 2. When the joint block 8 at the distal end of the piston rod 6*b* retracts, the slide block 7 is pulled by the flange portion 8*a* of the joint block 8 engaging an inner wall of the engaging portion 7*c* and retracts.

When the slide block 7 retracts, as shown in FIG. 2, the slide plate 4*e* of the rotary cam 4 moves from a flat horizontal surface to the cam surface 7*a* of the slide block 7 and rotates clockwise about the point "a". Subsequently, the rotation impelling surface 7*b* at a rear portion of the slide block 7 comes into abutment with the pin 9*b* of the restoring action block 9, and pushes the pin 9*b* rearward against the urging force of the coil spring 9*h*. In a state in which the pin 9*b* is pushed rearward and the rotation impelling surface 7*b* is in abutment with the abutting surface 9*f* of the restoring action block 9, when the slide block 7 pushes the restoring action block 9 further backward, the rotary cam 4 integral with the restoring action block 9 rotates clockwise about the point "a".

Figure 8A:
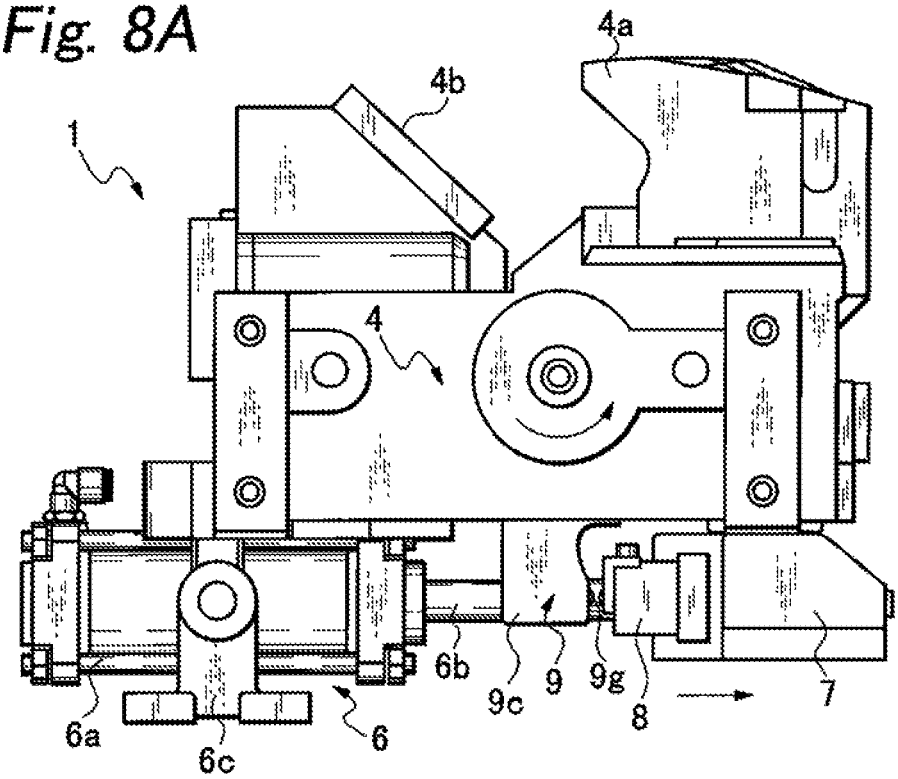
FIG. 8A is a front view showing a state in which the rotary cam is set in the same press working die assembly.
Figure 8B:
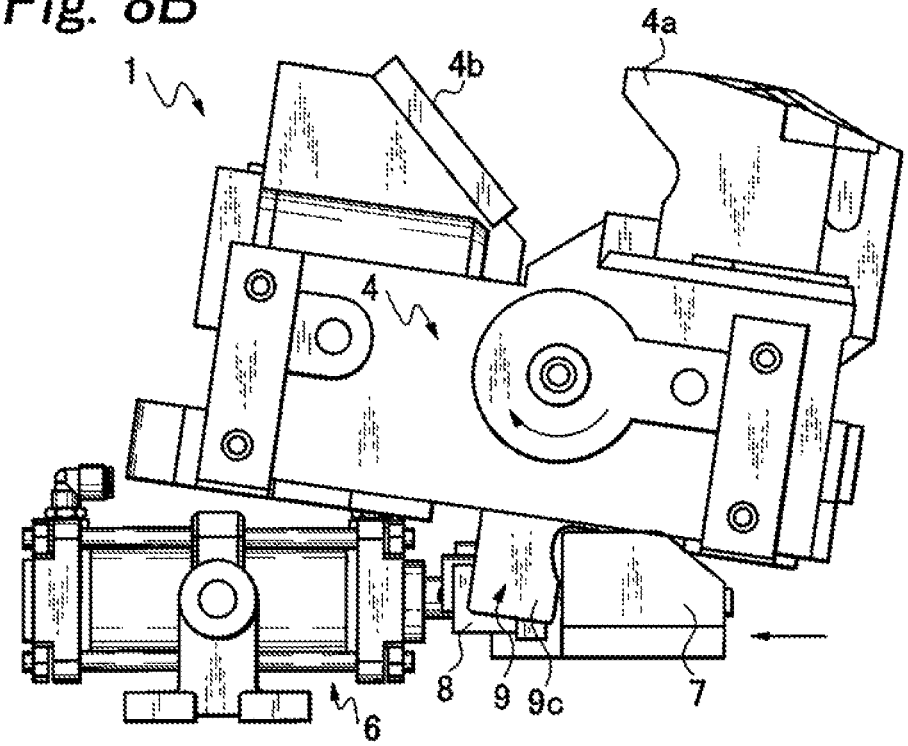
FIG. 8B is a front view showing a state before setting the same.
Figure 9:
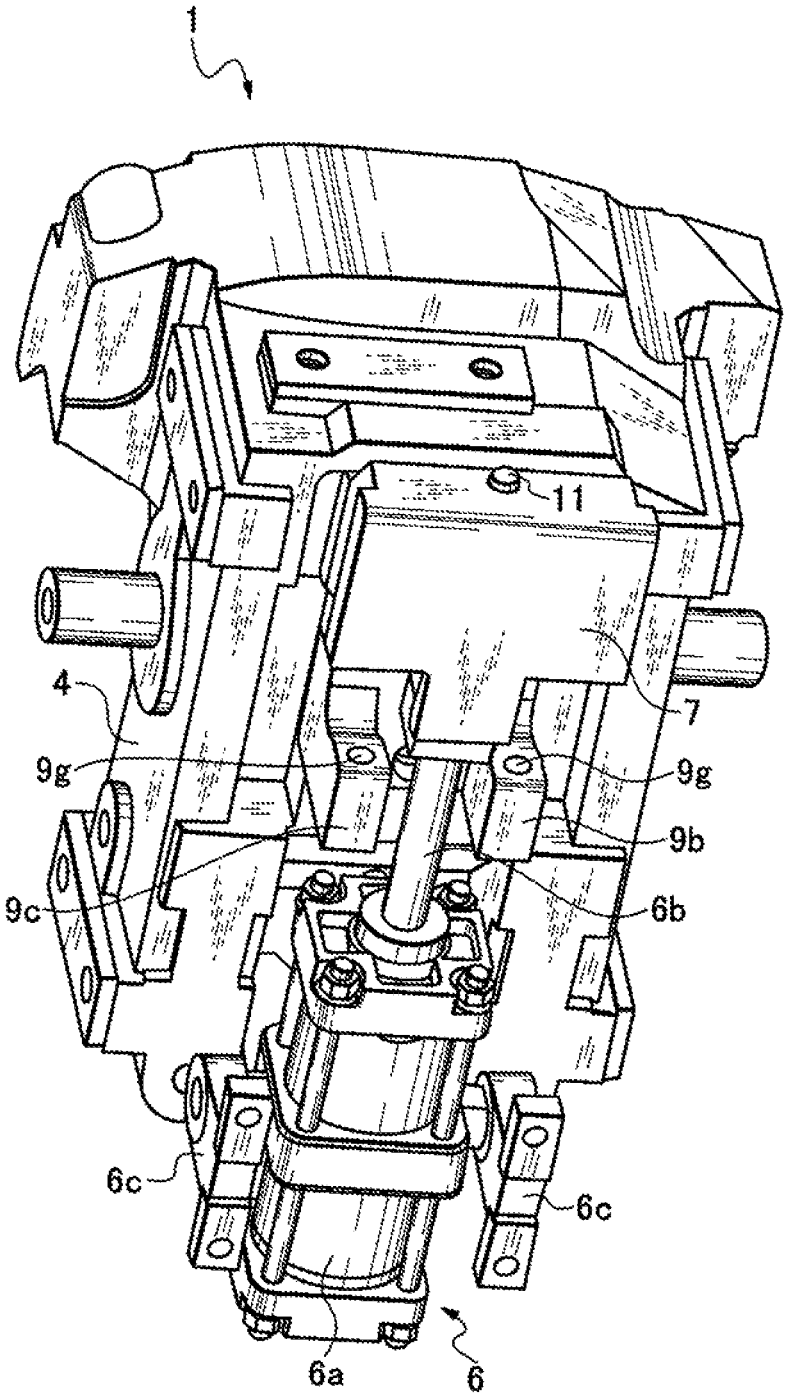
FIG. 9 is a perspective view of part of the same press working die assembly viewed from a bottom side.
Figure 10A:
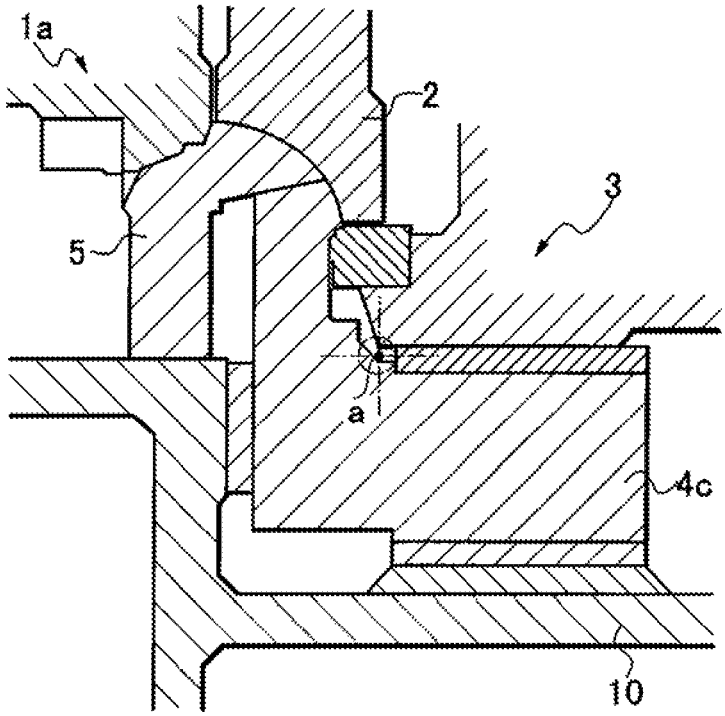
Fig. 10A PRIOR ART
FIG. 10A is a partly enlarged vertical cross-sectional view showing a state in which a rotary cam is set in a press working die assembly in the prior art.
Figure 10B:
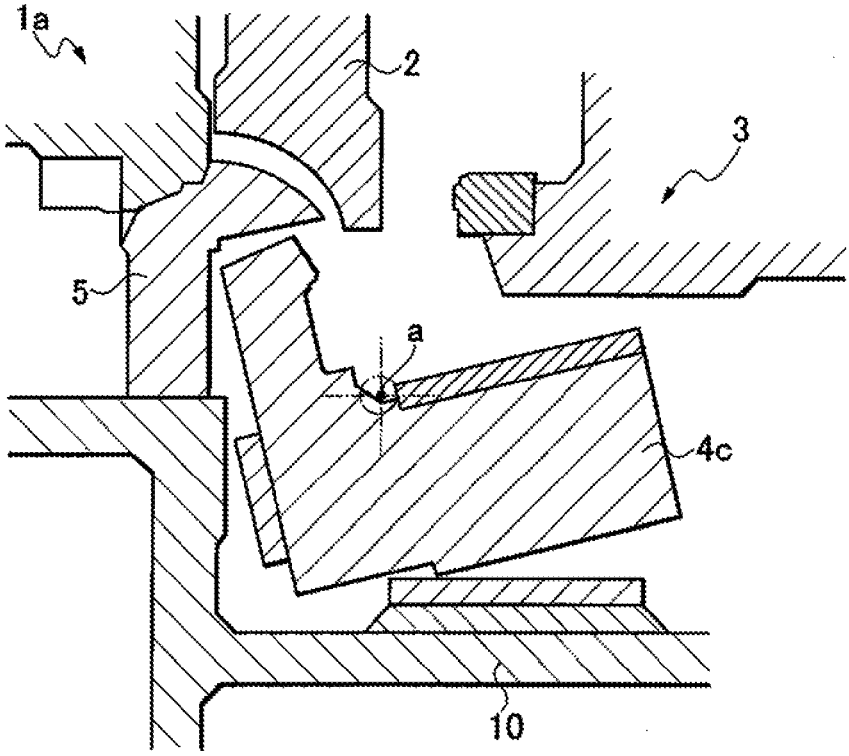
Fig. 10B PRIOR ART
FIG. 10B is a partly enlarged vertical cross-sectional view showing a state before setting the same.
Figure 11:
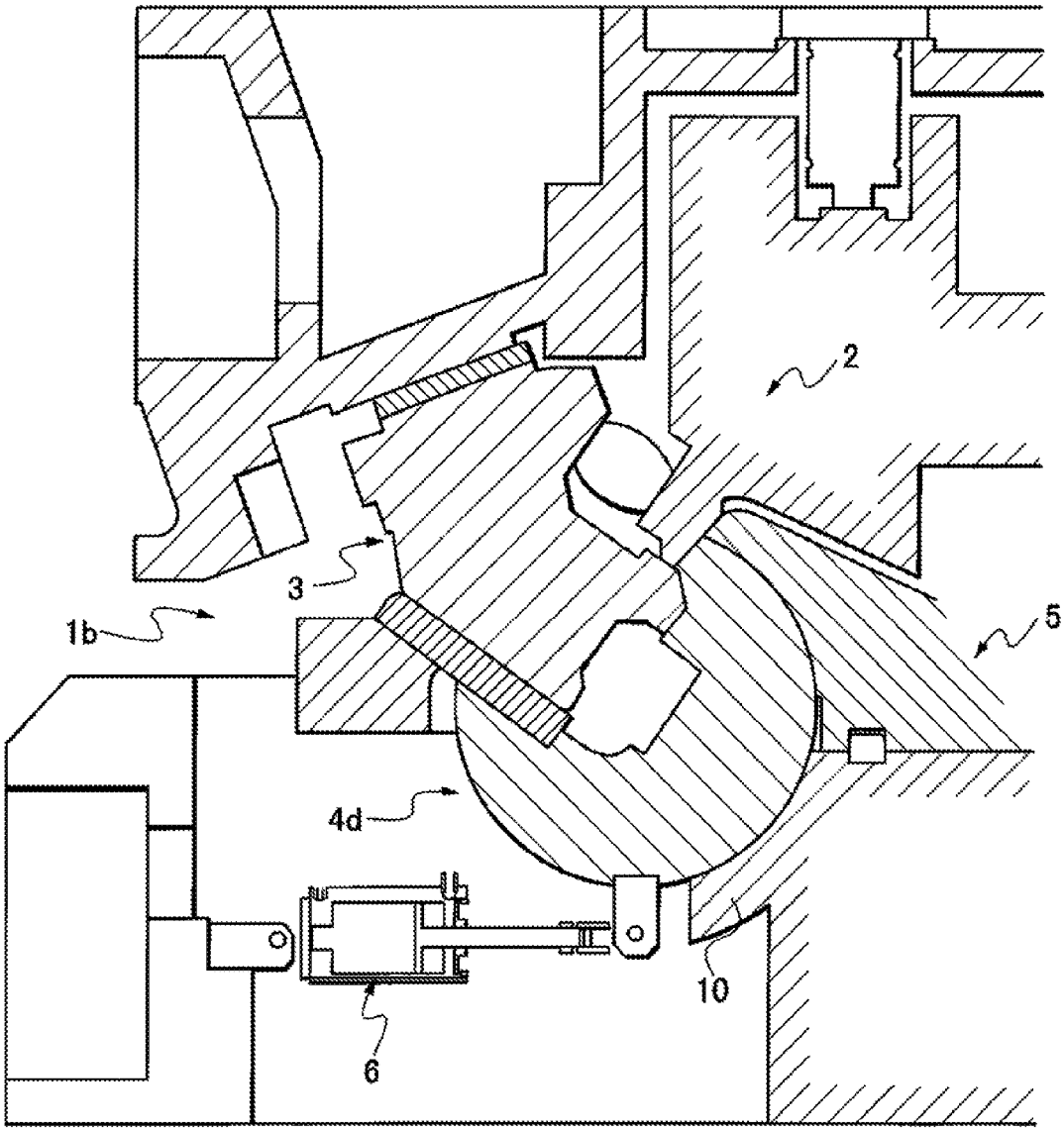
Fig. 11 PRIOR ART
FIG. 11 is a vertical cross-sectional view showing a state in which a column-shaped rotary cam is set in another press working die assembly in the prior art.
Figure 12A:
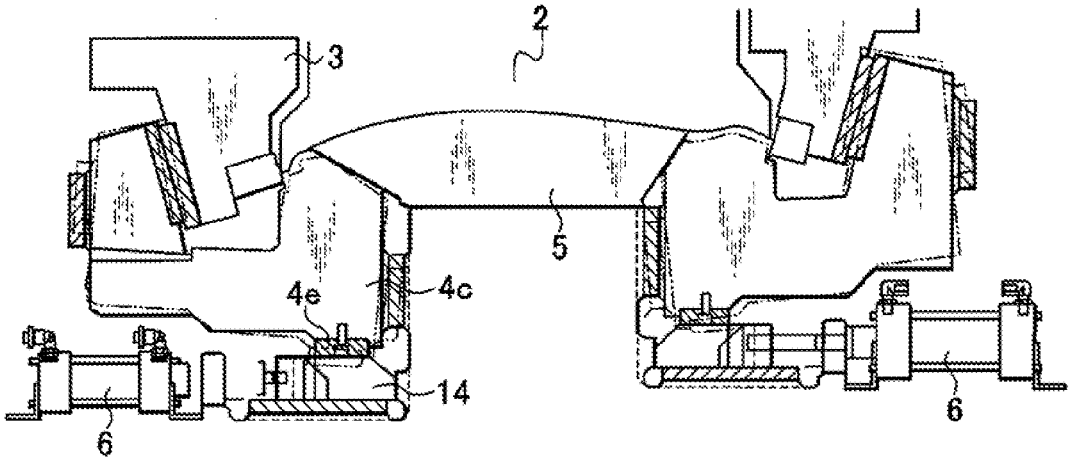
Fig. 12A PRIOR ART
FIG. 12A is a front view showing a state in which the rotary cam is set in the same press working die assembly in the prior art.
Figure 12B:
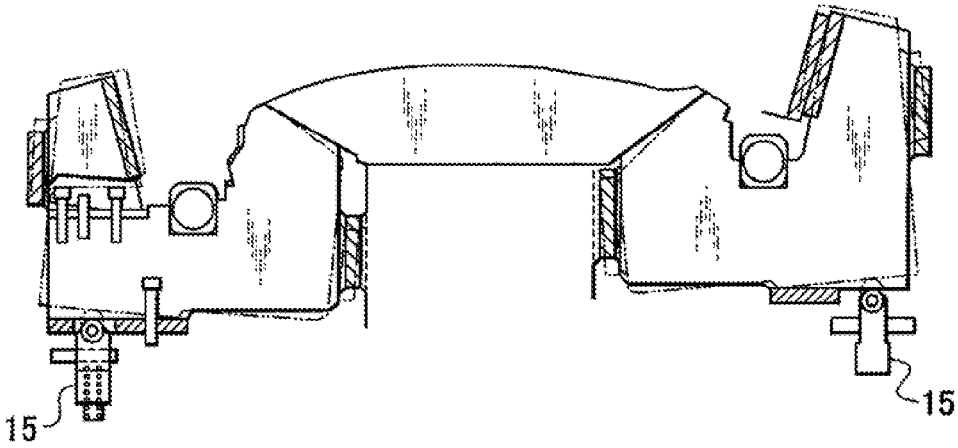
Fig. 12B PRIOR ART
FIG. 12B is a front view showing a scene before the rotary cam is set in the same press working die assembly in the prior art.

In this manner, the slide block 7 is pulled back by the piston rod 6*b* to a predetermined position, and the restoring action block 9 is rotated together with the rotary cam 4 clockwise and is restored to its original position. The upper die holder is restored to the initial state shown in FIG. 2 when having returned to the upper dead center, and repeats the states shown in FIG. 8A and FIG. 8B. In the slide block 7, the width of the rotary cam supporting surface 7*g*, which is an upper flat surface and which comes into contact with the slide plate 4*e* of the rotary cam 4 is reduced to be narrower than the distance between the rotation impelling surface 7*b* and abutting surfaces 9*f* of the restoring action block 9, so that the slide plate 4*e* is allowed to slide down to the cam surface 7*a* smoothly.

With the flange portion 8*a* of the joint block 8 fitted to and coupled with the engaging portion 7*c* of the slide block 7 from the side, only the force in the fore-and-aft direction acts on the piston rod 6*b* of the air cylinder 6*a*. In other words, the coupling between the piston rod 6*b* and the slide block 7 is configured to be an engaging state with a predetermined clearance by using the joint block 8 instead of a fixed state, so that direct application of a large pressing force of the rotary cam 4 with respect to the slide block 7 to the piston rod 6*b* is avoided.

In addition, as shown in FIG. 7C, the restoring action block 9 is formed into an inverted angular U-shape, and the restoring action block 9 is mounted so as to straddle the piston rod 6*b*, so that the interference with respect to the air cylinder 6*a* is avoided.

The press working die assembly according to the invention can be applied not only to the substantially L-shaped rotary cam for the negative angle formation, but also to a column type rotary cam.

What is claimed is:

1. A press working die assembly for forming a negative angle, comprising:

a pad secured to an upper die holder being freely movable upward and downward and configured to hold a workpiece;

a machining slide cam having cam surfaces on upper and lower sides and a bending edge on one end side, the machining slide cam being supported on the upper die holder or a lower die holder and being slidable laterally along the cam surfaces;

a rotary cam having a bending portion configured to form a negative angle portion on the workpiece, and a cam surface for the machining slide cam and being rotatably supported entirely on the lower die holder for rotation about an axis; and a reciprocating driving apparatus configured to rotate the rotary cam from an original position to a workpiece formation position, wherein the reciprocating driving apparatus includes a driven member, a driving unit operably connected to the driven member to drive the driven member in a reciprocating manner in forward and rearward directions, a slide block operably coupled to the driven member to be moved by the driven member in the forward and rearward directions, the slide block having a front end facing in said forward direction and a rear end facing in said rearward direction, an inclined cam surface provided at said front end of the slide block and configured to press against and cause rotation of the rotary cam from said original position toward said workpiece formation position in a first rotation direction about said axis, and a rotation impelling surface provided at said rear end of the slide block and configured to cause rotation of the rotary cam from said workpiece formation position toward said original position in a second rotation direction, opposite said first rotation direction, about said axis, and a restoring action block fixed to the rotary cam and configured to come into abutment with the rotation impelling surface at said rear end of the slide block, when the slide block is moved in said rearward direction, to restore the rotary cam to said original position, wherein the restoring action block is an inverted U-shaped member that comprises a mounting portion fixed to the rotary cam, and first and second leg column portions projecting from the mounting portion in a direction away from the rotary cam and straddling the driven member of the reciprocating driving apparatus.

2. The press working die assembly according to claim 1, wherein the slide block of the reciprocating driving apparatus includes a rotary cam supporting surface formed to receive a work pressing force of the pad generated at the time of negative angle formation with a plane orthogonal thereto.

3. The press working die assembly according to claim 1, wherein the driven member of the reciprocating driving apparatus comprises a piston rod, and the reciprocating driving apparatus further comprises a joint member between the piston rod and the slide block so as to couple the piston rod and the slide block for movement together.

4. The press working die assembly according to claim 1, wherein the mounting portion of the restoring action block is fixed to a lower surface of the rotary cam with a screw, so that the first and second column portions are hung downwardly from the mounting portion away from the rotary cam.

5. The press working die assembly according to claim 1, wherein a shock absorbing member is provided at the front end of the slide block and projects therefrom in the forward direction so as to alleviate shock generated when the slide block comes into abutment with a wall surface at a predetermined forward stop position.

6. The press working die assembly according to claim 1, wherein the first and second leg column portions of the restoring action block are provided with shock absorbing devices, respectively, that project from the leg column portions in the forward direction to come into abutment with the rotation impelling surface at the rear end of the slide block.

7. The press working die assembly according to claim 6, wherein the shock absorbing devices comprise pins that are spring-biased in the forward direction.

8. The press working die assembly according to claim 4, wherein the first and second leg column portions of the restoring action block are provided with shock absorbing devices, respectively, that project from the leg column portions in the forward direction to come into abutment with the rotation impelling surface at the rear end of the slide block.

9. The press working die assembly according to claim 8, wherein the shock absorbing devices comprise pins that are spring-biased in the forward direction.

* * * * *